United States Patent [19]

Bruggeman et al.

[11] 4,369,607

[45] Jan. 25, 1983

[54] SAND BLASTING APPARATUS

[75] Inventors: William L. Bruggeman, Bethel; Claude B. Myers, Brooklyn Park, both of Minn.

[73] Assignee: Cat Pumps Corporation, Minneapolis, Minn.

[21] Appl. No.: 160,589

[22] Filed: Jun. 18, 1980

[51] Int. Cl.[3] ..... B24B 5/04; B24B 7/00

[52] U.S. Cl. ..... 51/427; 51/436; 51/439

[58] Field of Search ..... 51/427, 436, 438, 439, 51/319, 321; 239/432, 433, 428, 428.5, DIG. 19

[56] References Cited

U.S. PATENT DOCUMENTS

| | | | |
|---|---|---|---|
| 821,415 | 5/1906 | Hess | 239/433 |
| 1,170,198 | 2/1916 | Sweet | 239/433 |
| 1,605,617 | 11/1926 | Ruemelin | 51/439 |
| 2,176,577 | 10/1939 | Tirrell | 51/321 |
| 2,200,587 | 5/1940 | Tirrell | 51/427 |
| 2,230,690 | 2/1941 | Lanza | 239/428 X |
| 2,333,264 | 11/1943 | McDermott | 51/439 |
| 2,594,735 | 4/1952 | Crumley | 239/DIG. 19 |
| 3,212,217 | 10/1965 | Furgason | 51/427 |
| 3,994,097 | 11/1976 | Lamb | 51/321 X |

FOREIGN PATENT DOCUMENTS

| | | | |
|---|---|---|---|
| 138771 | 12/1946 | Sweden | 51/439 |

*Primary Examiner*—Nicholas P. Godici

*Attorney, Agent, or Firm*—Hill, Van Santen, Steadman, Chiara & Simpson

[57] ABSTRACT

A sandblast apparatus includes a telescopically nested tubular abrasive induction probe operable as a vacuum conveyor for inducting an abrasive material into a discharge apparatus. The discharge apparatus is supplied with a source of water under pressure which enters the discharge apparatus as a stream and admixes with the abrasive material in a diverging chamber. The discharge device, formed of lightweight aluminum material has an air control to afford remote control of abrasive feed and to form a protective air shield for the abrasive stream. After admixture, the stream is discharged through a converging nozzle to a point of utilization.

8 Claims, 4 Drawing Figures

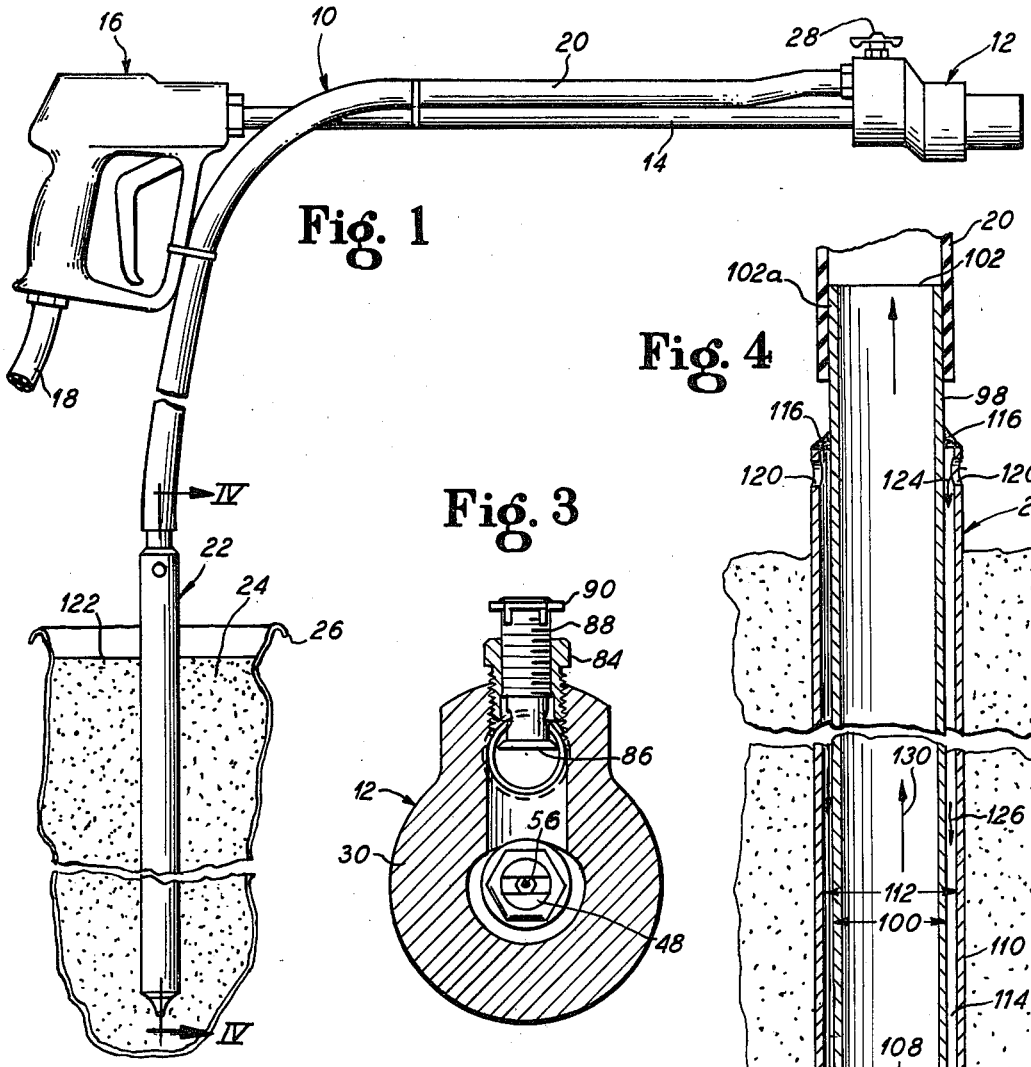
Fig. 1
Fig. 3
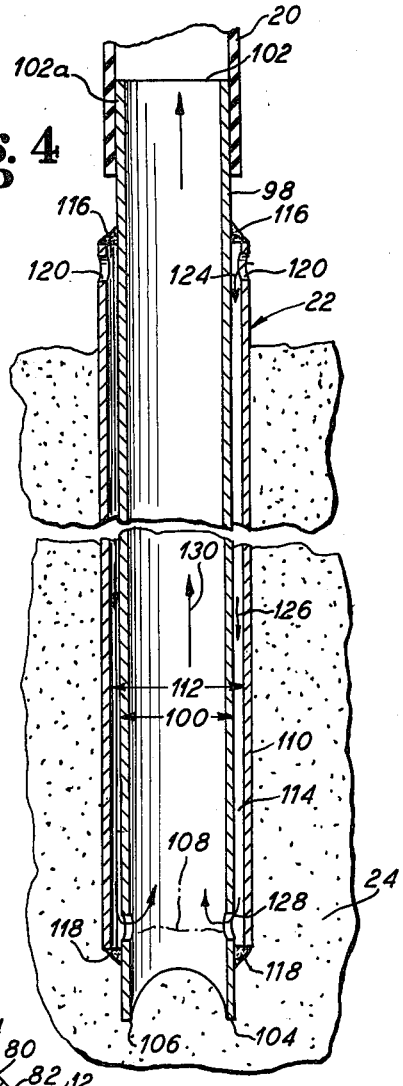
Fig. 4
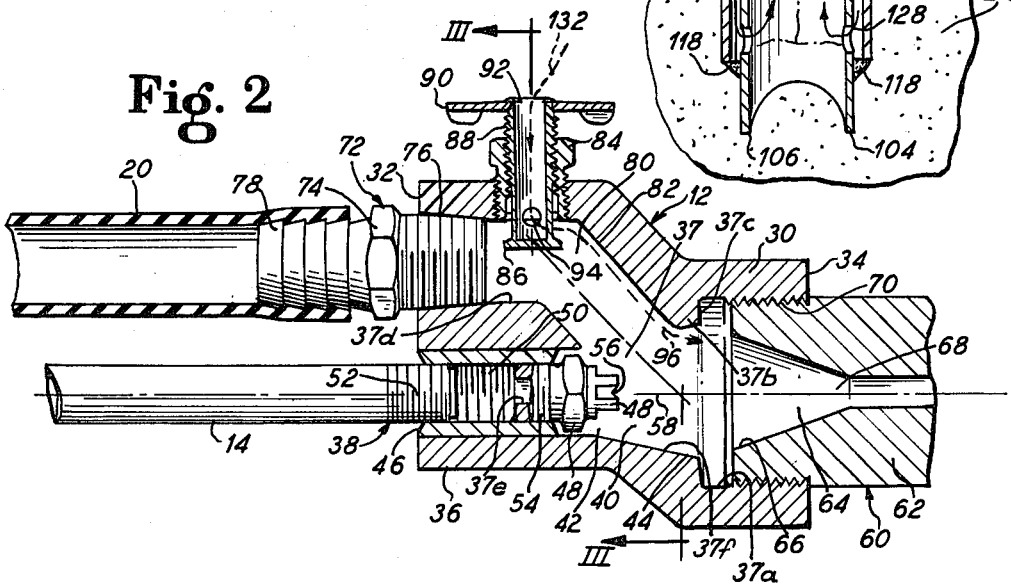
Fig. 2

SAND BLASTING APPARATUS

BACKGROUND OF THE INVENTION

1. Field of the Invention

This invention relates to a sand blasting apparatus using water as a propellant for the sand and a method of combining water and sand in a sand blasting operation.

2. Description of the Prior Art

Water propelled sand blasting apparatus systems generally include a source of water under pressure, a sand storage container, usually gravity fed, a nozzle for mixing and spraying the sand and water mixture and supply connections which permit the sand and water to go from their respective sources to the nozzle for mixing. These features are shown in U.S. Pat. No. 3,994,097 issued to Ralph Lamb on Nov. 30, 1976.

SUMMARY OF THE INVENTION

The present invention provides the improvement of an abrasive induction probe which permits a loose abrasive material to be inducted into the apparatus without the need for a gravity fed hopper. The abrasive material can be inducted from any container in which it is delivered, such as a bag or sack. A diverging nozzle within the discharge apparatus provides an improved mixing of the water and the abrasive material. The improvement of providing an air inlet in the discharge apparatus erects an air curtain for protection of adjacent surfaces and allows for that apparatus to be constructed of light-weight aluminum, thus obviating the need for additional support handles. The provision of the air inlet at the discharge also allows the operator to control the quantity of abrasive, thereby affording the operator remote control of the quantum of abrasive, i.e. the sand-water ratio or mixture control.

Thus, the invention provides for a more effective, lower weight and less expensive sand blasting apparatus and method.

BRIEF DESCRIPTION OF THE DRAWINGS

FIG. 1 is a side elevational view of the sand blasting apparatus including an induction probe, and a discharge device;

FIG. 2 is a sectional view of the discharge device shown in FIG. 1;

FIG. 3 is a sectional view of the discharge device taken generally along the lines III—III of FIG. 2; and FIG. 4 is a sectional view of the induction probe taken generally along the lines IV—IV of FIG. 1.

DESCRIPTION OF THE PREFERRED EMBODIMENTS

A sand blast apparatus is generally shown in FIG. 1 at 10 and is comprised of an abrasive discharge apparatus 12 located at an end of a water conduit pipe 14 opposite an end which is connected to a pistol grip control valve 16. A water supply hose 18 connects the pistol grip control valve 16 to a source of water under pressure (not shown). An abrasive conduit 20 connects on one end of the abrasive discharge apparatus 12 and on the opposite end to a probe 22. The probe 22 is inserted into an abrasive material 24 such as sand which may be in a container 26 such as a sack or a rigid container.

In accordance with this invention an air inlet control means 28 is located directly on the abrasive discharge apparatus or device 12. The abrasive discharge apparatus or device 12 is shown in greater detail in FIG. 2.

This cut-away view shows a housing 30 having two end walls 32 and 34 and a side wall 36.

The body or housing 30 of the abrasive discharge apparatus 12 is particularly characterized by a through passage means 37 which includes at one end a cylindrical opening **37*a* intersecting the end wall 34 and having interiorly threaded wall portions as at 70 for effecting a coupling connection with a matingly threaded discharge nozzle means shown generally at 60**.

Inwardly of the end wall 34, the passage means 37 is interrupted by a radially inwardly extending annular shoulder **37*b* forming a radial shoulder 37*c***.

Extending in an axial direction from the shoulder **37*b* towards the end wall 32, the through-passage means 37 is characterized by an expanding diverging wall 37*f* which encloses a chamber 40 from which two separate axial passages extend to intersect the end wall 32, a first axial passage 37*d* and a second axial passage 37*e***.

With respect to the passage **37*e*, it will be noted that the entire casting 12 is made of aluminum. It is contemplated by this invention that a stainless steel sleeve 46 is cast integrally with the body 12 and is placed in firm assembly therewith. The stainless steel sleeve 46 is interiorly threaded as at 46*a*, thereby to matingly receive an exteriorly threaded water conduit pipe 14 through which the passage 37*e* extends. Accordingly, the passage 37*e* is designed to feed water through the conduit 14 and into a nozzle shown at 48**.

A water inlet means 38 is located in the end wall 32 and communicates with the passage 37 of the housing at a diverging chamber 40 formed therein. The diverging chamber 40 has a narrow end 42 and a large end 44, the narow end 42 being adjacent the water inlet means 38. The water inlet means 38 includes the water conduit pipe 14 which is mounted in the stainless steel receiving sleeve 46 which is integrally molded into the aluminum material of the end wall 32. A water nozzle means 48 is removably mounted in an opposite end of the receiving sleeve 46 by a screw thread arrangement and projects into the diverging chamber 40. The water conduit pipe 14 has external threads 52 for sealing engagement with the internal threads 50 of the stainless steel sleeve. Also the water nozzle means 48 is provided with external threads 54 for sealing in a likewise manner.

By virtue of the housing 30 being constructed of a light-weight material such as aluminum, the operation of the sand blasting apparatus is considerably enhanced because the need of special support handles is obviated.

By making the receiving sleeve 46 of a highly durable material such as stainless steel and molding the part in place at the same time the housing 30 is molded as an integral part of the housing, various parts which are constantly threaded and unthreaded therefrom such as the water nozzle means 48 and the water conduit pipe 14 may be removed and replaced in the normal course of operation without adversely affecting the light-weight body.

The water nozzle means 48 has an orifice 56 in an end thereof which is projecting into the diverging chamber 40 and which is located on an axis 58 of the water conduit pipe 14. Various nozzle means 48 may be used with differing sized orifices 56 to allow for different rates of flow of water through the abrasive discharge apparatus 12.

A discharge outlet means 60 is located in end wall 34 and is comprised of a generally cylindrical nozzle housing 62 having an interior passage 64 being of a converging shape having a large end 66 adjacent the diverging chamber 40 and a narrow end 68 at an opposite end thereof. The nozzle housing 62 is concentrically mounted about the axis 58 of the water nozzle means 48 and is adjustably retained in place by means of a screw thread arrangement at 70.

An abrasive inlet means 72 is located in end wall 32 laterally displaced from the axis 58 of the water inlet means 48. The abrasive inlet means 72 is comprised of a connection member 74 being removably retained in the end wall 32 by means of a screw thread arrangement at 76. The abrasive conduit 20 is attached to the connection member 74 by means of a friction fit at 78. The axis of the abrasive inlet means is disposed generally parallel to the axis 58 of the water nozzle means 48. A passageway 80 connects the abrasive inlet means 72 with the diverging chamber 40.

Since the axis of the abrasive inlet means is laterally displaced from the axis 58 of the water nozzle means 48, the passageway 80 has a curved shape so as to change the direction of flow of the abrasive material from the abrasive inlet axial direction towards the water nozzle axis 58 thereby allowing the abrasive material to discharge through the discharge outlet means 60.

In accordance with this invention the air inlet means 28 is located directly on the discharge device and is comprised of a valve body 84 forming a control seat regulated by an axially advanceable valve head 86 on the end of an actuating shaft 88. The shaft 88 extends upwardly into a readily accessible position on the upper part of the discharge device and a finger-manipulable handle 90 is provided thereon. The valve shaft 88 is of a hollow construction with an opening 92 at one end vented to atmosphere and having a hole 94 at the valve head end which projects into the passageway 80 when the valve shaft 88 is advanced. During operation when the valve shaft 88 is advanced and the hole 94 projects into the passageway 80, air is inducted at opening 92.

Because of the abrasive nature of the stream of abrasive material flowing through the passageway 80, a portion of the wall identified at 82 disposed generally transversely of the passage **37*d* is subject to substantial deterioration. To alleviate this problem, the air inlet means 28 location in the side wall 36 of the housing 30 adjacent the abrasive inlet means and communicating with the passageway 80** erects a protective air curtain.

Air flows through the hole 94 adjacent the vulnerable portion of the wall 82 as shown by the dotted arrow 96, forming a curtain of air along that portion of the wall. This curtain of air protects the housing wall from erosion by the steam of abrasive material flowing through the passageway 80.

By locating the air inlet means 28 at the discharge, the operator is given the further advantage of remote control over the sand-water ratio or mixture, without going to the pick up end of the sand probe.

According to the present invention, the probe 22 overcomes the zero inertia of the body of abrasive because as soon as the end 104 is inserted into the abrasive, particles of abrasive are immediately introduced into a stream with an initial velocity. Thus, the probe functions as a vacuum conveyor so that the abrasive air stream proceeds at high velocity towards the discharge nozzle.

In other words, a mixture of air and abrasive is transmitted instead of solid abrasive, thus avoiding clogging of the conduit.

The probe 22 is shown in detail in FIG. 4, and is comprised of a first tubular member 98 having a first exterior diameter 100 and having an upper end 102 and a lower end 104. The upper end 102 is connected to the abrasive carrying conduit 20 by means of a friction fit as at **102*a*. The lower end 104 is open at 106 and is adapted to be placed within the abrasive material 24. Further, air induction holes 108 are provided near the lower end 104 of the probe 22**.

A second tubular member 110 having an interior or second diameter 112 greater than that of the first tubular member's exterior diameter 100 is concentrically mounted about the first tubular member 98 so as to form an annular chamber 114 between the two tubular members. The top of the second tubular member is sealed to the first tubular member in an air-tight manner, for example, by means of a weldment 116. Likewise, the lower end of the second tubular member is also sealed at 118 in a like manner.

The lower seal 118 is between the lower end 104 of the first tubular member and the air induction holes 108 of the first tubular member, thus placing the air induction holes 108 within the annular chamber 114. The second tubular member 110 contains air induction holes 120 formed therein near the upper end thereof. These air induction holes 120 also communicate with the annular chamber 114 thus forming a passageway for air from atmosphere through the air induction holes 120, the annular chamber 114, the air induction holes 108, and into the interior of the first tubular member 98. By virtue of such arrangement, when vacuum is drawn on the probe 22, an air stream with a positive initial velocity is provided and particles of abrasive are readily admixed with such moving air stream since zero inertia is overcome. Thus, the system operates as a vacuum conveyor.

In operation the water supply hose 18 is connected to a source of water under pressure and the probe 22 is placed within a source of loose abrasive material such that the air induction holes 120 of the second tubular member are above a surface 122 of the abrasive material 24. The discharge outlet means is directed toward an area which is desired to be abraded and the control valve 16 is opened permitting the water under pressure to flow through the water conduit pipe 14 into the abrasive discharge apparatus 12.

As the high pressure water stream exits the water conduit pipe 14 through the orifice 56 in the water nozzle means 48 and flows through the diverging chamber 40 into the nozzle housing, a partial vacuum is formed by a venturi action in the diverging chamber 40. This partial vacuum causes a lower pressure in passageway 80, the abrasive conduit 20 and in the probe 22. Such lower pressure in the probe causes air to be inducted into the air induction holes 120 and the second tubular member 110 as shown by the arrow at 124, flowing down through the annular chamber 114 as shown by arrow 126 through the air induction hole 118 in the first tubular member 98 as shown by arrow 128 and up through the interior of the first tubular member as shown by arrow 130.

That air flow is partially through the loose abrasive material which has entered the probe through the opening at 106 upon placement of the probe into the abrasive material. The air admixes with the abrasive material making an air-abrasive material mixture with fluid-like properties for flowing and which flows up through the interior of the probe 22, through the abrasive conduit 20 and into the passageway 80.

The lower pressure in passageway 80 also inducts air in through the air inlet means 28 as shown at arrow 132 which flows down through the interior of the valve shaft 88 through the hole 94 and along the wall portion 82 of the passageway 80. This curtain of air protects the wall portion at 82 from the forceful stream of air and abrasive material entering the passageway 80 through the abrasive inlet means 72. This air-abrasive material mixture flows through passageway 80 into chamber 40 where it admixes with the stream of high pressure water from the water nozzle means 48 and exits through the interior passage 64 of the discharge outlet means 60 towards the area being abraded.

The shape of the diverging chamber 40 transforms some of the kinetic energy of the high pressure stream exiting from the water nozzle means 48 into static pressure which results in a more effective admixing of the water with the air-abrasive material mixture and permits a greater amount of abrasive material to be drawn into the abrasive discharge apparatus 12 for admixture and utilization for a given water pressure setting.

By having the air control means 28 at the discharge device, the operator is given a remote control advantage with regard to the abrasive and he need not worry about controlling the air flow at the abrasive source far from the situs of the work area.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. In a blaster for jetting abrasive and water, the improvement of, a discharge device having a body member made of light-weight aluminum material, passage means formed in said body adapted to receive a discharge nozzle in the exit end of the passage means for discharging an admixed stream of water and abrasive towards a work surface, a water-receiving passage in said passage means including a nozzle to direct water in the form of a jet through said passage means and into said discharge nozzle, said passage means including an enlarged mixing zone through which the water jet is directed thereby to draw a vacuum in said passage means by a venturi action, and an abrasive passage in said passage means having a first leg with an inlet opening for coupling to a source of abrasive, and a second leg angled towards said mixing zone and having a wall susceptible to erosion by the flow of abrasive from said first leg to said second leg, and air inlet control means between said two legs having a manual control regulator in a readily accessible location for manipulation by the operator, and an air vent which when opened by the operator will admit air and form an air curtain over said wall of said second leg, thereby to protect said wall against erosion, said air inlet control means affording the operator remote control over the quantum of abrasive directed into the stream.

2. In a blaster for jetting abrasive and water, the improvement of, a discharge device having a body member made of light-weight aluminum material, passage means formed in said body adapted to receive a discharge nozzle in the exit end of the passage means for discharging an admixed stream of water and abrasive towards a work surface, a water-receiving passage in said passage means including a nozzle to direct water in the form of a jet through said passage means and into said discharge nozzle, said passage means including an enlarged mixing zone through which the water jet is directed thereby to draw a vacuum in said passage means by a venturi action, and an abrasive passage in said passage means having a first leg with an inlet opening for coupling to a source of abrasive, and a second leg angled towards said mixing zone and having a wall susceptible to erosion by the flow of abrasive from said first leg to said second leg, and air inlet control means between said two legs having a manual control regulator in a readily accessible location for manipulation by the operator, and an air vent which when opened by the operator will admit air and form an air curtain over said wall of said second leg, thereby to protect said wall against erosion, said air inlet control means affording the operator remote control over the quantum of abrasive directed into the stream, and an abrasive conduit connected to said abrasive passage having a probe at the end of said abrasive conduit for ingesting granular abrasive from a supply, said probe comprising elongated inner and outer tubular conduits forming an annular air space therebetween and an inner cylindrical passage, an atmospheric vent at one end in the outside conduit allowing air from the atmosphere to course through said annular air space, a passage vent at the other end in the inner conduit allowing air to be drawn into the passage from said annular air space, an opening in said other end of said inner conduit forming an abrasive inlet, and means to draw a vacuum on said passage, whereby a stream of air will immediately move at discernible velocity through said passage and granules of abrasive will be ingested at said inlet and admixed with said stream of air so that the probe operates as a vacuum conveyor in transmitting abrasive to the discharge device.

3. A sand and water blaster comprising, in combination, a pistol grip water gun having a wand with a discharge device at the end thereof, said gun having a coupling by means of which water under pressure is admitted to the gun and metered to the discharge device, venturi nozzle means in the discharge device through which the water is directed in the form of a stream, thereby to draw a vacuum in the discharge device, and abrasive pick-up means connected to an abrasive passage in said discharge device for ingesting ganulated abrasive by vacuum for admixture with the water stream in the discharge device, said abrasive passage in said discharge device having a first leg with an inlet for coupling to said abrasive pick-up means, and a second leg angled towards said venturi nozzle means and having a wall susceptible to erosion by the flow of abrasive from said first leg to said second leg, said discharge device having an air venting control directly on said discharge device which when opened by the operator will admit air and form an air curtain over said wall of said second leg, thereby to protect said wall against erosion, and in addition, affording the operator remote control of the abrasive pick-up.

4. A sand and water blaster as defined in claim 3 and said abrasive pick-up means having a probe for ingesting granular abrasive comprising elongated inner and outer tubular conduits forming an annular air space therebetween and having an inner cylindrical flow passage extending therethrough, an atmospheric vent at one end in the outside conduit allowing air from the atmosphere to course through said annular air space, a passage vent at the other end in the inner conduit allowing air to be drawn into the passage from said annular air space, an opening in said other end of said inner conduit forming an abrasive inlet, said venturi nozzle means in the discharge device drawing a vacuum in the discharge device and transmitting said vacuum to said proble for ingesting the granular abrasive material.

5. A sand blasting apparatus comprising:

a discharge apparatus, said discharge apparatus comprising:

a housing having two end walls and side walls enclosing said end walls and forming a passage therein, a water inlet means formed on one end of said housing and having an opening communicating with said passage for directing a stream of water under pressure along an axis of said water inlet means, a discharge outlet member in the opposite end wall from said water inlet means, said outlet discharge means being mounted concentrically about said axis of said water inlet means and spaced longitudinally apart from said water inlet means, an abrasive inlet means in said same end wall as said water inlet means laterally displaced from said axis of said water inlet means, a diverging chamber formed concentrically about said axis of said inlet means having a smaller end adjacent said water inlet means and a larger end adjacent said discharge outlet means, a passageway connecting said abrasive inlet means with said diverging chamber, said connecting passageway having an air inlet means for forming a curtain of air along the wall of said passageway, an abrasive supply connection to an abrasive induction probe inserted into a source of abrasive material, whereby said water under pressure flows through said discharge apparatus drawing said abrasive material through said induction probe and into said discharge apparatus whereupon said water and said abrasive material admix and are discharged from said discharge apparatus in an abrasive stream.

6. In a blaster for jetting abrasive and water, the improvement of:

a discharge device with passage means formed in said discharge device, said passage means comprising:

first and second parallel axial inlet passages, an enlarged mixing zone communicating with said axial passages, and a discharge opening passage parallel with said axial passages and communicating with said mixing zone, said first axial passage being an abrasive passage and having a first parallel inlet leg in a second leg angled towards said mixing zone and having a wall susceptible to erosion by the flow of abrasive from said first leg to said second leg, a controllable air inlet between said two legs which will admit air and form an air curtain over said wall of said second leg, thereby to protect said wall against erosion.

7. The device of claim 6, wherein said first axial passage has an abrasive supply connection at the inlet end to an abrasive induction probe inserted into a source of abrasive material.

8. The apparatus of claim 6, wherein said enlarged mixing zone comprises a diverging chamber formed concentrically about an axis of said second inlet passage having a smaller end adjacent said inlet passage and a larger end adjacent said discharge opening passage.

* * * * *